US006042633A

United States Patent [19]

Brotzmann et al.

[11] Patent Number: 6,042,633

[45] Date of Patent: Mar. 28, 2000

[54] PROCESS FOR POST-COMBUSTION OF REACTION GASES PRODUCED DURING THE VACUUM PROCESSING OF STEEL

[75] Inventors: Karl Brotzmann, Amberg; Heinz Holtermann, Meerbusch, both of Germany

[73] Assignee: Technometal Gesellschaft für Metalltechnologie mbH, Germany

[21] Appl. No.: 09/029,568

[22] PCT Filed: May 18, 1996

[86] PCT No.: PCT/DE96/00902

§ 371 Date: Nov. 26, 1997

§ 102(e) Date: Nov. 26, 1997

[87] PCT Pub. No.: WO96/37633

PCT Pub. Date: Nov. 28, 1996

[30] Foreign Application Priority Data

May 25, 1995 [DE] Germany ..... 195 18 900

[51] Int. Cl.[7] ..... C21C 7/10

[52] U.S. Cl. ..... 75/508; 75/512; 266/208

[58] Field of Search ..... 75/508, 512, 511, 75/548; 266/208, 209, 210

[56] References Cited

U.S. PATENT DOCUMENTS 4,979,983 12/1990 Nishikawa et al. ..... 75/511

5,571,307 11/1996 Sizov et al. ..... 75/512

FOREIGN PATENT DOCUMENTS 0347884 12/1989 European Pat. Off. .

1575991 7/1968 France .

1433691 3/1969 Germany .

4130590 3/1993 Germany .

1195239 1/1988 Japan .

3226515 1/1990 Japan .

*Primary Examiner*—Scott Kastler

*Attorney, Agent, or Firm*—Robert W. Becker & Associates

[57] ABSTRACT

A method for after combustion of reaction gases resulting from the decarburization of liquid steel in reaction vessels under vacuum includes the steps of arranging a blow-in opening within a refractory lining of a reaction vessel and introducing an air stream, comprised of hot air of a temperature between 800° C. to 1400° C., counter to the flow direction of the reaction gases via the blow-in opening into the reaction vessel. A device for performing after combustion of reaction gases resulting from the decarburization of liquid steel in a reaction vessel under vacuum includes a generator, connected to the reaction vessel, for producing hot air. The generator contains a bulk of balls for heating the air guided through the bulk of balls and subsequently introduced into the reaction vessel. The bulk of balls consists of a refractory material and is heated by heat energy.

10 Claims, 3 Drawing Sheets

PROCESS FOR POST-COMBUSTION OF REACTION GASES PRODUCED DURING THE VACUUM PROCESSING OF STEEL

BACKGROUND OF THE INVENTION

The invention relates to a method for after combustion of reaction gases resulting from the decarburization of liquid steel in reaction vessels under vacuum.

In DE 41 30 590 C2 a degassing vessel is provided as a reaction vessel for the vacuum treatment of liquid steel. In this printed document it is disclosed that particles are entrained by a degassing current of the reaction gases which leads to a pronounced deposit formation of steel splashes in the upper part of the reaction vessel and in the area of the connecting line to the vacuum pump. Such steel deposits may have a considerable weight and finally may almost close off the upper end of the reaction vessel so that, in general, such steel deposits must be removed in a complicated manner by melting.

For avoiding the formation of such steel deposits, a method is suggested in EP 0 347 884 B1, which defines the closest prior art, to the instant invention with which an after combustion of the resulting reaction gases is desired. In the context of this known method, oxygen or an oxygen containing gas is blown via a pipe insertable to a defined spacing above the surface of the liquid steel within the steel bath in an amount to be calculated. With this known method three effects are to be achieved jointly, i.e., the decarburization of the steel by supplying oxygen, a heating of the steel bath, as well as an after combustion of the reaction gases resulting from the vacuum treatment. In practice, it was shown that with the known method the prevention of steel deposits especially in elongate, respectively, tall reaction vessels cannot be prevented sufficiently reliably.

SUMMARY OF THE INVENTION

It is therefore an object of the invention to improve a method of the aforementioned kind such that the danger of formation of steel deposits in the reaction vessel can be further reduced. Furthermore, a device is to be disclosed that is suitable for performing the improved method.

The solution to this object, including advantageous embodiments and developments, can be taken from the disclosure of the specipication.

The invention is based on the principle that a stream of air is introduced counter to the flow direction of the reaction gases via the blow-in opening into the reaction vessel, whereby the blow-in opening is arranged within the refractory lining. With the invention it is advantageously achieved that due to the supply of air an excellent after combustion of the reaction gases takes place so that, due to the resulting heat, the formation of steel deposits can be prevented.

According to a preferred embodiment of the invention, it is suggested that the air is introduced as hot air with a temperature between 800° C. to 1400° C. This has the advantage that the hot air, due to its own high blow-velocity, has a substantially higher energy impulse and accordingly penetrates in the direction of length/height of the reaction vessel, counter to the flow direction of the reaction gases, very deeply into the reaction vessel. This results in a sufficiently strong mixing turbulence of the reaction gases and the hot air stream which results in an improved combustion of the reaction gases and in an improved heat transfer to the inner side of the wall of the reaction vessel. The reason for this is that the air under conventional conditions can be introduced into the reaction vessel only with maximally the speed of sound. For cold air this speed of sound is only 330 m/sec. while the speed of sound for air at a temperature of, for example, 1200° C. is approximately 800 m/sec. By using hot air, it is thus possible to introduce the air into the reaction vessel at substantially increased velocity.

In a simplified manner, the introduction of air into the reaction gases in the reaction vessel results in an elongate, large flame which can be controlled by the amount of air as well as by the velocity of air being blown in. By providing such a large flame it is possible to melt quickly even existing large steel deposits. Advantageously, the exhaust gases of the after combustion of the reaction gases, resulting from the introduction of air, are relatively cold so that the exhaust gas treatment of the exhaust gases removed from the reaction vessel is also simplified.

According to one embodiment of the invention, the introduced amount of air is calculated such that the amount of reaction gases, calculated based on the amount of the steel batch to be degassed, is combusted completely stoichiometrically. It is understood that for achieving this goal the amount of air to be blown in must be matched to the amount of evolving reaction gases.

According to one embodiment of the invention, it is suggested that the introduction of air is carried out for the entire time period of vacuum degassing of the liquid steel. This measure ensures that during the vacuum treatment of the steel an exhaust gas can be produced that is substantially free of CO.

Since it is well known that within a first time period, for example, within the first three minutes of a vacuum decarburization that takes approximately 12 minutes, approximately 50% of the reaction gases are already removed and that during the following three minutes another 25% are removed, it is expedient according to one embodiment of the invention to concentrate the introduction of air onto the first time period of the vacuum treatment of the liquid steel whereby this first time period may correspond to the first half of the entire treatment period.

According to alternative embodiments of the invention, it is suggested that the introduction of air into the reaction vessel is carried out only for every second or third batch because it may be desirable that for the protection of the refractory lining of the reaction vessel a thin steel coat should remain on the vessel wall.

In a manner known per se, the inventive method for after combustion of the reaction gases can also be combined with an accelerated decarburization treatment of the liquid steel in which oxygen is introduced into that steel bath via an insertable pipe.

An expedient device for performing this method is designed such that a suitable generator for generating the hot air is provided and that the generator inventively comprises a bulk of balls heatable by heat energy and comprised of a refractory material for the purpose of heating the air to be guided through the bulk of balls. For heating the bulk consisting of balls a separate burner may be provided according to one embodiment of the invention but it is also possible that the generator is connected to the reaction vessel for waste heat recovery so that the hot air resulting after the treatment can be used for heating the bulk consisting of balls.

BRIEF DESCRIPTION OF THE DRAWING

The drawing shows embodiments of the invention which will be described in the following. It is shown in.

DESCRIPTION OF THE PREFERRED EMBODIMENTS

Figure 1:
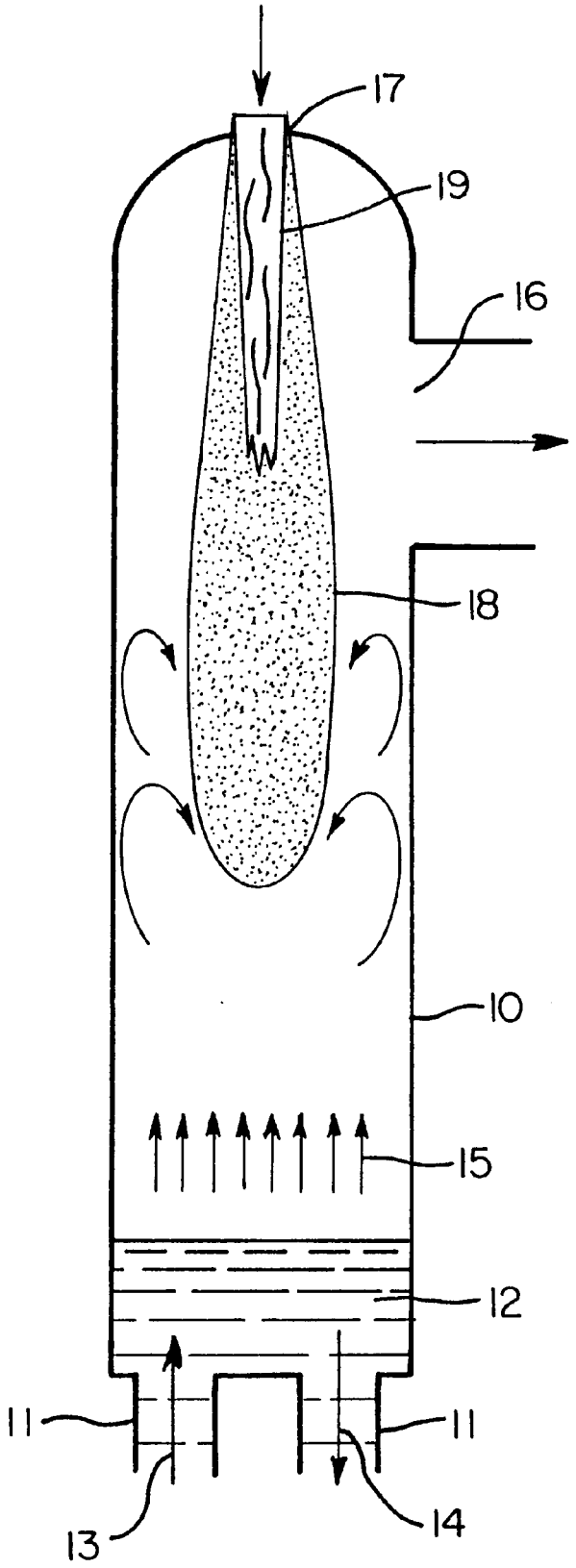
FIG. 1 a schematic representation of a reaction vessel during introduction of hot air.

As can be seen in FIG. 1, the reaction vessel 10 is provided at its lower end with two immersion tubes 11 with which the reaction vessel can be connected to the steel reservoir in which the liquid steel is contained. When vacuum is supplied by a vacuum pump to the reaction vessel via connector 16, the steel bath 12 will rise in the direction of arrow 13 from the non-represented steel reservoir and enter the reaction vessel 10. After corresponding treatment, respectively, degassing, it flows in the direction of arrow 14 back into the steel reservoir. During this treatment, reaction gases 15 leave the steel bath 12 and flow in the direction of the connector opening 16 or to the vacuum pump.

At the upper lid of the reaction vessel 10 a blow-in opening 17 is provided via which, in the shown embodiment, hot air is blown into the reaction vessel 10, respectively, via which hot air is sucked into the reaction vessel 10 by the vacuum present therein, whereby a flame 19 is formed away from the blow-in opening 17. It is surrounded by the hot air column 18, respectively, it extends therein. The conditions shown in FIG. 1 are based on the hot air blown in at a velocity of 600 m/sec. and at a flow velocity of the reaction gases of 15 m/rsec., whereby for a total height of the reaction vessel of 10 to 12 m the hot air can penetrate deeply into the reaction vessel 10 and thus ensure heat transfer into the lower area of the reaction vessel.

Figure 2:
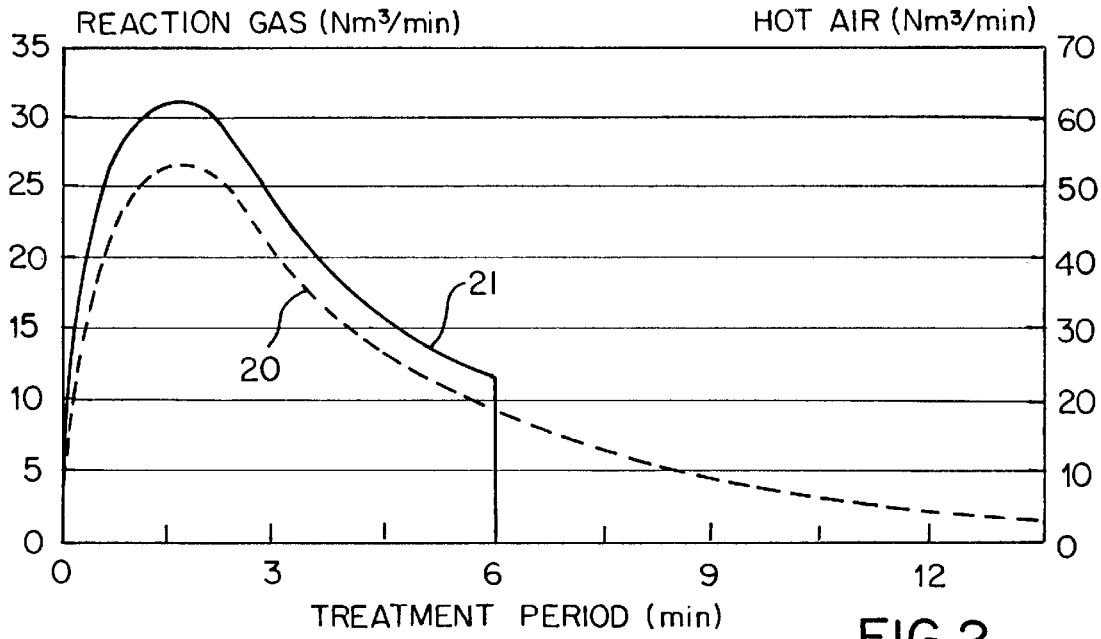
FIG. 2 a diagram showing the ratio of formed reaction gases and the amount of air blown over the treatment period.

FIG. 2 shows the corresponding vacuum treatment, respectively, hot air introduction whereby respectively the amount of reaction gas or of hot air is shown as a function of the treatment period. This representation is based on a vacuum treatment of a steel batch of 280 metric tons. The curve 20 shows the amount of removed reaction gas for the treatment period of approximately 12 minutes. The hot air is introduced at a temperature of 1200° C. in an amount shown in to the curve 21 along the axis of time whereby in the represented embodiment the introduction of hot air is limited to half of the treatment period, i.e., to six minutes. The measured exhaust gas temperature was approximately 1800° C. and, based on this, energy in the amount of 0.88 GJ is available for melting steel deposits. This is sufficient to melt away a steel deposit of approximately 1.5 metric tons.

Figure 3:
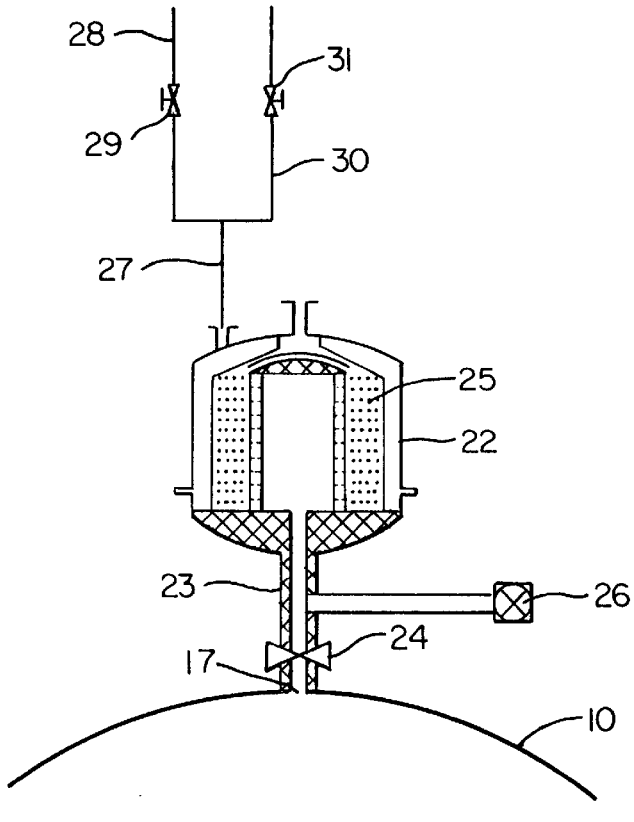
FIG. 3 a generator for hot air generation in connection with the reaction vessel in a schematic representation.

FIG. 3 shows an expedient generator arrangement for generating hot air whereby the respective generator 22 is connected by connecting line 23 to the blow-in opening 17 for the hot air to be introduced into the reaction vessel 10. The connecting line 23 can be closed off by valve 24.

The generator 22 comprises a bulk 25 of balls consisting of refractory material whereby for heating the bulk of balls 25 a separate burner 26 is provided which can be operated by gas. The burner 26 is also connected to the connecting line 23. An air supply line 27 extends into the generator which branches to form an exhaust gas line **28*b* that can be shut off by a valve 29 and an inlet line 30 that can be shut off by a valve 31**.

During heating of the bulk of balls 25, the valve 24 as well as the valve 31 of the inlet line 30 are closed. Thus, the hot exhaust gases introduced by the gas burner 26 can flow through the bulk of balls 25 and can exit via the exhaust gas line 28 when the valve 29 is opened. For the introduction of hot air, the valve 29 is closed and the valves 31 and 24 are opened. Due the vacuum present within the reaction vessel 10, the air can be introduced via the lines 30 and 27 into the generator 22 and is heated by the heated bulk of balls 25 to the desired temperature. The heated hot air is then introduced via the connecting line 23, when the valve 24 is open, into the reaction vessel 10 via the blow-in opening 17. It is expedient that the connecting line 23 between the generator 22 and the reaction vessel 10 is as short as possible. Furthermore, the blow-in opening 17 within the reaction vessel is to be dimensioned such that for the respectively present inner pressure, respectively, vacuum within the reaction vessel the best possible flow conditions for the introduction of hot air are provided.

Figure 4:
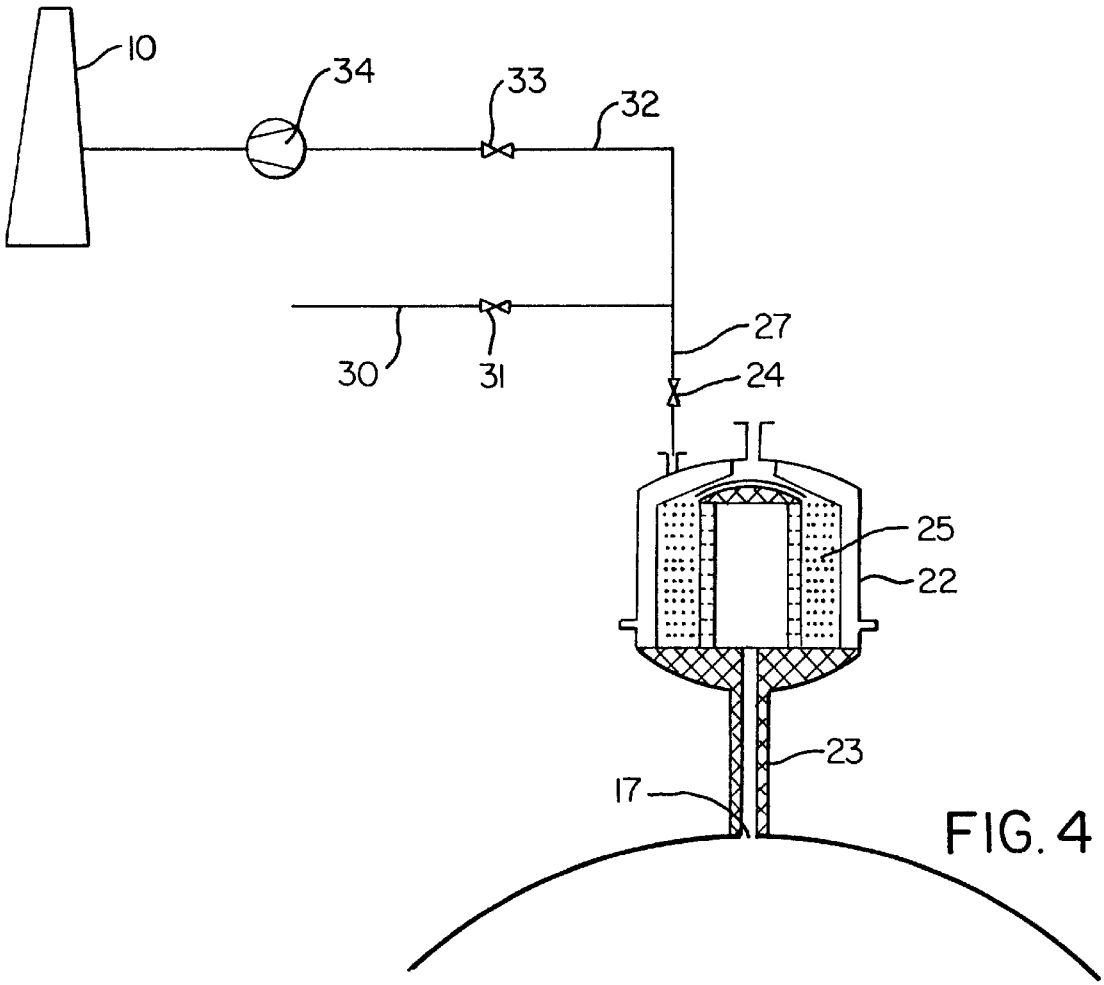
FIG. 4 the generator of FIG. 3 in another embodiment.

In the embodiment represented in FIG. 4, the recovery of waste heat within the reaction vessel is suggested whereby the air supply line 27 branches into an inlet line 30 and into a connecting line 32 extending to the reaction vessel 10. The connecting line 32 can be closed off by a valve 33, and a suction fan 34 may also be provided in this line. In this embodiment, the valve 24 is no longer arranged within the connecting line 23 between the generator 22 and the reaction vessel 10, but is positioned within the air supply line 27.

In this embodiment the heating of the bulk of balls 25 by passing in hot air provided within the reaction vessel 10 is carried out when the valve 24 and the valve 33 are open and the suction fan 34 is running, whereby, after heating of the filling 25, the valve 33 is closed while the valve 31 within the inlet line is opened so that the air can enter via the air supply line 27 into the heated bulk of balls 25. From here, it can flow via the connecting line 23 to the reaction vessel 10. In both embodiments, the amount of hot air to be introduced into the reaction vessel 10 can be controlled as a function of the vacuum present within the reaction vessel 10 by the valve 24.

The present invention is, of course, in no way restricted to the specific disclosure of the specification and drawings, but also encompasses any modifications within the scope of the appended claims.

What is claimed is:

1. A method for after combustion of reaction gases resulting from the decarburization of liquid steel in reaction vessels under vacuum, including the steps of:

arranging a blow-in opening within a refractory lining of a reaction vessel; and introducing an air stream, comprised of hot air of a temperature between 800° C. to 1400° C., counter to the flow direction of the reaction gases via the blow-in opening into the reaction vessel.

2. A method according to claim 1, wherein in the step of introducing the amount of air of the air stream is calculated such that the amount of reaction gases calculated based on the steel batch to be degassed is burnt completely stoichiometrically.

3. A method according to claim 1, wherein the step of introducing is carried out over the entire time period of decarburization of the liquid steel under vacuum.

4. A method according to claim 1, wherein the step of introducing is limited to a first portion of the time period of decarburization of the liquid steel under vacuum, wherein the first portion is limited to half the time period of decarburization.

5. A method according to claim 1, wherein the method is used for batches of liquid steel and wherein the step of introducing is carried out for every other batch.

6. A method according to claim 1, wherein the method is used for batches of liquid steel and wherein the step of introducing is carried out for every third batch.

7. A method according to claim 1, further comprising the step of blowing oxygen into the liquid steel via a pipe that can be inserted into the reaction vessel for an accelerated decarburization of the liquid steel.

8. A device for performing after combustion of reaction gases resulting from the decarburization of liquid steel in a reaction vessel under vacuum, said device comprising:

a generator for producing hot air connected to the reaction vessel;

said generator comprising a bulk of balls for heating the air guided through said bulk of balls and subsequently introduced into the reaction vessel;

said bulk of balls comprised of a refractory material and heated by heat energy.

9. A device according to claim 8, comprising a separate burner for heating said bulk of balls.

10. A device according to claim 8, wherein said generator is connected to the reaction vessel for waste heat recovery to be used for heating said bulk of balls.

* * * * *

UNITED STATES PATENT AND TRADEMARK OFFICE

CERTIFICATE OF CORRECTION

PATENT NO : 6,042,633

DATED : Mar. 28, 2000

INVENTOR(S) : Karl Brotzmann and Heinz Holtermann

It is certified that error appears in the above-identified patent and that said Letters Patent are hereby corrected as shown below:

On the title page, the following items should read as follows:

[54] Title

METHOD FOR AFTER COMBUSTION OF REACTION GASES RESULTING FROM VACUUM TREATMENT OF STEEL

Signed and Sealed this

Third Day of April, 2001

*Attest:*

Nicholas P. Godici

NICHOLAS P. GODICI

*Attesting Officer*

*Acting Director of the United States Patent and Trademark Office*